United States Patent [19]

Bidwell et al.

[11] Patent Number: 4,982,840

[45] Date of Patent: Jan. 8, 1991

[54] METHOD AND APPARATUS FOR CONVERTING BARREL TYPE UNITS INTO FREE STANDING MERCHANDISING DISPLAYS FOR HOLDING CHILLED PRODUCTS AND THE LIKE

[75] Inventors: Christopher C. Bidwell, Beverly Lake, Ga.; Dewalt W. Fowler, Manchester, Mo.

[73] Assignee: Paul Flum Ideas, Inc., St. Louis, Mo.

[21] Appl. No.: 434,095

[22] Filed: Nov. 8, 1989

[51] Int. Cl.[5] ..... B65D 69/00

[52] U.S. Cl. ..... 206/223; 62/457.1; 62/463; 62/464; 493/95

[58] Field of Search ..... 206/44 R, 223, 459; 62/457.1, 457.3, 459, 462, 463, 464, 465; 220/411, 412, 413; 493/95, 100

[56] References Cited

U.S. PATENT DOCUMENTS

| | | | |
|---|---|---|---|
| 949,211 | 2/1910 | Boerner | 62/463 |
| 1,002,333 | 9/1911 | Stollberg | 62/463 |
| 1,590,563 | 6/1926 | Shultz | 62/463 |
| 3,128,904 | 4/1964 | Reilly | 493/100 |
| 3,178,903 | 4/1965 | Protor | 62/464 |
| 3,737,093 | 6/1973 | Amberg et al. | 206/459 |
| 4,347,713 | 9/1982 | Morrison et al. | 62/464 |
| 4,403,483 | 9/1983 | Lisalda | 62/464 |
| 4,424,687 | 1/1984 | Morgan | 62/463 |
| 4,546,900 | 10/1985 | Lackey | 62/457.1 |
| 4,638,645 | 1/1987 | Simila | 62/457.1 |
| 4,724,682 | 2/1988 | Flum et al. | 62/462 |
| 4,825,549 | 5/1989 | Huang | 30/293 |

*Primary Examiner*—David T. Fidei

*Attorney, Agent, or Firm*—Haverstock, Garrett & Roberts

[57] ABSTRACT

A method and apparatus for converting a barrel type unit into an assembly for holding chilled products, particularly, barrel units having an upper annular portion of a smaller circumference as compared to other annular portions thereof, the barrel unit also including top and bottom end closure walls, the method including supplying a kit of separate components including a tub member adapted to hold ice and product positioned therein, and a sizing device for determining the proper location for severing the barrel side wall, the tub member having an annular support flange associated with the upper portion thereof adapted to be cooperatively engageable with a peripheral edge portion of the barrel unit when the barrel unit is severed at a particular location therearound, the sizing device enabling a user to locate the particular location on the barrel side wall at which to sever the same such that the annular edge resulting therefrom will be compatible with the annular support flange associated with the tub member. Once the proper severance location is determined, the barrel unit is severed at such predetermined location and the tub member is positioned therewithin such that the annular support flange engages the severed edge portion of the barrel unit. The tub member may also include a fluid outlet to drain the waste water from the melted ice which will accumulate therein, and drain tubing can be provided and attached to conduct the waste water from the tub member to a suitable location exterior the assembly.

14 Claims, 3 Drawing Sheets

METHOD AND APPARATUS FOR CONVERTING BARREL TYPE UNITS INTO FREE STANDING MERCHANDISING DISPLAYS FOR HOLDING CHILLED PRODUCTS AND THE LIKE

The present invention relates to a method and apparatus for converting molded plastic barrel units commonly used in the soft drink beverage industry for holding and transporting a wide variety of soft drink concentrates and/or syrups into free standing merchandising display units adaptable for holding and displaying chilled products such as chilled bottled or canned soft drink beverages. The present conversion means transforms the present concentrate and/or syrup barrels into a unit that is visually attractive to prospective customers and attractively displays the chilled articles stored therein in a readily accessible manner for easy removal therefrom.

Molded plastic barrel containers of various sizes are commonly used in the soft drink beverage industry for holding the various concentrates and syrups utilized in producing the various soft drink flavors marketed by soft drink producers. These molded plastic barrels are typically of a one-piece construction and, once the syrup and/or concentrate is totally depleted from therewithin, such barrels are typically discarded. Since these barrels are extremely sturdy in construction and are rather substantial in size, their disposal is not always easily accomplished and, depending upon the particular method of disposal, such disposal can present environmental and safety problems. Also, until properly disposed of, these empty barrels take up valuable warehouse space.

In the merchandising of single unit articles such as bottled or canned soft drink and juice type beverages and, particularly, those impulse items which are desired pre-chilled by customers and are normally sold in single units, there is always a need to have a container which will accommodate the storing and chilling of a reasonable number of such articles for easY access by prospective customers. This is particularly true in our fast-moving and highly mobile society where pre-chilled soft drink and fruit juice products are routinely purchased for consumption on the go.

The present invention satisfies a two-fold need, namely, it eliminates the disposal problem associated with such syrup and/or concentrate barrels and, in addition, it provides a much needed point-of-sale merchandising unit adaptable for storing and displaying chilled products to consumers. Also, importantly, the present invention not only satisfies the foregoing needs, but it does so in an inexpensive way by providing a relatively simple method for converting these syrup type plastic barrels into an attractive chilled container assembly, which conversion can be easily accomplished with minimal tools by non-skilled personnel. The resultant, finished display unit, after conversion, is attractive and eye-catching to prospective shoppers and buyers; it requires minimal floor space; it can be easily and quickly strategically located at a point-of-sale location; it is adapted for easy and simple refilling with product and ice; and it includes means for storing and emptying the waste chilled water accumulated therein from the melted ice.

Summary Of The Invention

The present method and components for accomplishing the above-identified barrel conversion are as follows. Since the concentrate and/or syrup contained in such molded plastic barrels are removed therefrom through a relatively small opening located on the top portion of the barrel, the first task is to open up the top portion of the barrel so that a pre-fabricated chilling tub or insert liner may be inserted therewithin. This is accomplished by circumferentially cutting the barrel at a predetermined distance from the top so that the entire top closed portion of the barrel can be removed to provide access therewithin. The actual cutting of the molded plastic barrel can be accomplished by any suitable cutting means such as by the use of a conventional saber saw. However, establishment of the exact location from the top of the barrel at which to cut and remove the top portion thereof is critical as the diameter and circumference of the open-ended barrel at the location where such barrel is cut must be of sufficient dimension to engage the projecting downturned support means of the chilling tub positioned therewithin. This is particularly true of those syrup type barrels which are not of uniform diameter throughout their entire height but instead include upper and/or lower annular portions having a smaller circumference or girth as compared to other portions thereof. If the molded plastic barrel is cut at a location which produces a top annular edge not compatible for engagement with the downturned support means associated with the present chilling tub, then the chilling tub will not mate with the severed barrel and will not be adequately supported when filled with product and ice. For this reason, establishment of the proper location at which to cut and remove the top closed portion of the concentrate and/or syrup barrel is important, particularly when the diameter of such barrel varies over its entire height.

Since the various embodiments of the known barrels presently in use in the soft drink industry are substantially standardized and uniform with respect to their shape and their various heights and diameters, the above-discussed predetermined distances can be easily established through the use of any one of a variety of means such as a template, a sizing ring, a specially designed tool or any other such sizing aid. Various sizing means for accomplishing this task are disclosed herein.

Once the top portion of the molded plastic barrel is removed as aforementioned, a drain hole sized to receive the drainage tubing is drilled or otherwise formed in the lower portion of the barrel side wall. The partially modified barrel is now ready to receive the chilling tub and associated insulation as well as the drainage means for emptying the waste chilled water accumulated therewithin. However, prior to insertion of the chilling tub, the barrel as presently modified should be thoroughly cleaned, both inside and out, so as to remove any syrup and/or concentrate residue which may remain therewithin and to also clean the exterior portion thereof so that the finished unit will be free of any scuff marks or other dirt and attractive and pleasing to the eye.

The present chilling tub is preferably made of a lightweight plastic material, although other materials such as styrofoam may likewise be used, and takes the form of a substantially cylindrical tub having reservoir means formed integral therewith at the bottom portion thereof. The integrally formed reservoir is capable of holding a substantial liquid capacity and includes a fluid outlet nipple associated with the lowermost portion thereof for allowing the waste chilled water to escape therefrom. A substantially flat floor member or reservoir plate is located immediately above the reservoir intermediate the top and bottom portion of the chilling tub and separates the reservoir from the product holding portion of the tub. The chilling tub is shaped and sized to fit within the modified severed barrel and, in its preferred embodiment, includes a projecting and downturned rim terminating the top edge of the annular side wall associated therewith. The projecting downturned rim fits over the top edge of the severed barrel in such a manner that the entire chilling tub is supported by such top edge. Of great importance is the fact that the present chilling tub is standardized in size and shape so as to mate with any number of the existing syrup and/or concentrate barrels presently in use depending upon where such barrels are severed adjacent the top portion thereof as will be hereinafter further explained.

The present chilling tub also includes insulation means which is positioned to surround and insulate the bottom and sides of the chilling tub. Any suitable insulation means such as a foam type insulation may be used to insulate the chilling tub so as to keep the articles placed therein cold for as long as possible. Plastic tubing or other tube means is connected to the fluid outlet nipple associated with the reservoir means and is fed through the drain hole located on one side of the modified barrel to the exterior thereof. Clamp means are positioned on the terminal end portion of the drain tube to control removal of the waste chilled water from the reservoir means. This provides a simple and easy means for emptying the reservoir without having to unload or move the chilling tub from the overall assembly.

The chilling tub is likewise suitably provided with one flat segment of its periphery to accommodate a hinge means for attaching a lid member to the rim of the chilling tub. Resting upon and hingedly attached to the projecting and downturned rim associated with the chilling tub is preferably a see-through lid member which is designed to rest upon the inner portion of such rim. The lid member may be injection molded or vacuum formed from a clear type plastic material and is suitably provided with generally triangularly shaped bosses, two of which bosses are located on each opposite side of the hinge means and a third boss which is located on the circumference of the lid member opposite the midpoint of the hinge means. The two bosses located adjacent the hinge means serve to maintain the lid member in an open and substantially erect position when fully raised to such position and the third boss serves as a convenient handle means for grasping and opening the lid. The clear plastic lid serves to close the chilling tub, provides visibility of its contents, and provides ready access to the articles therein by customers. Lid members of various shapes and styles may also be used in conjunction with the present tub member.

Signage and other indicia may be affixed to the exterior portion of the converted barrel to enhance its appearance and/or to promote the sale of the chilled items stored therein. This signage is provided in the form of a graphic wrap which may be easily and conveniently adhesively attached to the exterior portion of the barrel side wall in a conventional manner.

Several different embodiments of the present chilling tub are disclosed herein, some embodiments including additional support structure in the lower portion thereof for engagement with the product holding floor member associated therewith so as to provide additional strength and support thereto. This additional reinforcing means gives support to the product holding floor member under the full weight of the ice and the various product containers positioned within the product holding portion of the chilling tub.

It is therefore a principal object of the present invention to provide means for converting syrup and/or concentrate barrels commonly used in the soft drink industry into free standing merchandising units for holding chilled products.

Another object is to provide a container assembly for conveniently and attractively merchandising chilled products.

Another object is to teach a method for converting a barrel type unit into a container assembly for holding chilled products, which conversion can be accomplished by non-skilled personnel with minimum tool requirements.

Another object is to provide a conversion kit which includes the necessary components and teaches the present method for converting such barrel units into a visually attractive and easily accessible container assembly for storing and displaying chilled products.

Another object is to teach a conversion means which transforms an otherwise empty barrel into a container assembly for chilled articles that can be easily and readily drained of melted ice water without emptying or otherwise dismantling the entire container assembly.

Another object is to teach means in the form of various devices to accurately determine where to sever the upper portion of a known concentrate barrel in order to have the present chilling tub properly engage and be supported by the top peripheral edge of such severed barrel.

These and other objects and advantages of the present invention will become apparent to those skilled in the art after considering the following detailed specification of several representative embodiments of the subject method and apparatus in conjunction with the accompanying drawings wherein:

Description Of The Preferred Embodiment

Figure 1:
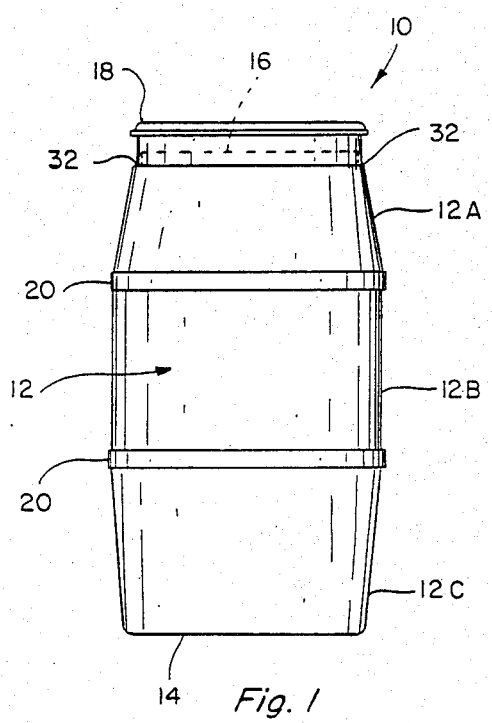
FIG. 1 is a side elevational view of a typical syrup and/or concentrate barrel presently used in the soft drink industry.

Referring to the drawings more particularly by reference numbers wherein like numerals refer to like parts, number 10 in FIG. 1 identifies a typical molded plastic syrup and/or concentrate barrel commonly used in the soft drink beverage industry as previously explained. Although several different types of syrup and/or concentrate barrels are presently being used throughout the industry and some variations do exist with respect to size and shape, the barrel 10 illustrated in FIG. 1 is representative of many of such barrels. The barrel 10 is substantially cylindrical in shape and includes an annular side wall 12, a substantially flat bottom wall 14, and a substantially flat top wall 16. As can be seen from FIG. 1, the barrel side wall 12 is somewhat tapered or frusto-conical in shape at its upper and lower end portions. This means that the diameter or circumference of the center annular portion 12B is greater than the diameter or circumference of the top and bottom end portions 12A and 12C. Other embodiments of such concentrate barrels also include barrels having a frusto-conically shaped upper portion only and more traditionally shaped barrels having a uniform diameter or girth throughout their entire height. Such barrels 10 also typically include a nesting ring such as the nesting ring 18 which extends above the top wall 16 and is provided as a means for nesting one barrel on top of the other. The nesting ring 18 provides some means for holding and securing such barrels in a vertically stacked arrangement. The barrel 10 may also further include a pair of horizontally oriented annular reinforcing members 20 positioned as shown in FIG. 1, the annular members 20 providing additional strength and rigidity to the overall barrel 10. An opening (not shown) is formed in the top wall 16 of the barrel 10 to provide access for removing the syrup or concentrate contained therewithin. Once the barrel 10 is depleted of its contents, it is ready for conversion into a free standing point-of-sale assembly for holding chilled products and the like in accordance with the teachings of the present invention.

Figure 3:
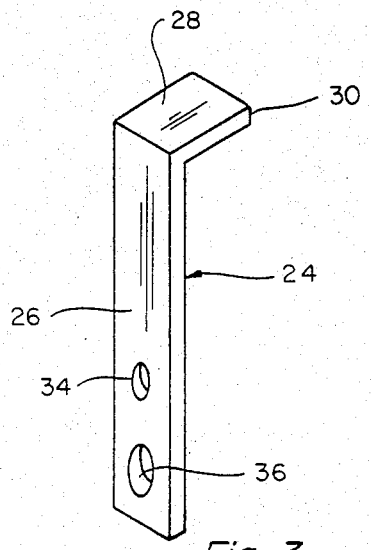
FIG. 3 is a side elevational view of the tool shown in FIG. 2 for predetermining the severance line adjacent the top portion of the barrel.
Figure 2:
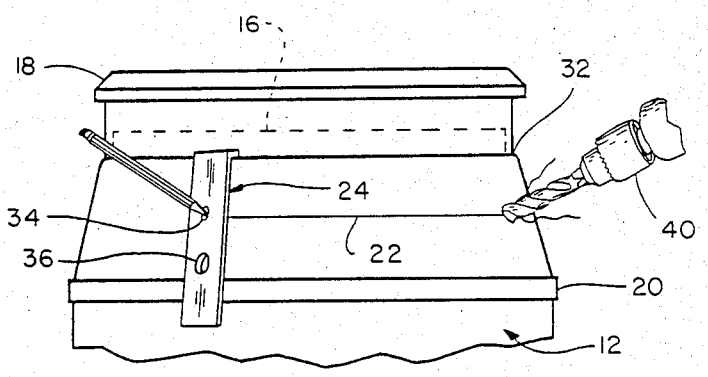
FIG. 2 is a partial side elevational view showing one method for predetermining the location adjacent the top portion of the barrel at which to sever the same.

Since the barrel 10 has a substantially closed top wall 16, the first step in converting the barrel 10 to an assembly for holding chilled products is to open up the top portion thereof so that the chilling tub 50 may be inserted therewithin. This is accomplished by severing the top portion of the barrel 10 at a predetermined location. Establishment of this predetermined severance line such as the severance line 22 shown in FIG. 2 is predicated upon the diameter and circumference of the engaging rim 58 associated with the chilling tub 50 as will be hereinafter further explained. Since the size and shape of the various syrup and/or concentrate barrels presently used in the soft drink beverage industry are known, and since most such barrels include a frusto-conical upper annular portion, various means in the form of templates and other tools or aids can be developed to precisely establish the severance line 22. One such means for accomplishing this task is the tool or template 24 illustrated in FIGS. 2 and 3. The tool 24 is substantially L-shaped in construction and includes an elongated portion 26 and a relatively short flange portion 28 formed integral therewith at one end of the tool portion 26 as best shown in FIG. 3. The tool portion 28 is substantially perpendicular to the portion 26 and includes a terminal end 30 as shown in FIG. 3. The terminal end 30 is specifically shaped and dimensioned to fit into and ride upon the annular lip or groove 32 formed at the upper portion of the barrel 10 by and between the location where the annular nesting ring 18 mates with the annular barrel side wall 12.

The elongated tool portion 26 includes a plurality of openings extending therethrough such as the openings 34 and 36 shown in FIGS. 2 and 3. These openings are positioned so as to locate the exact position on the barrel 10, relative to the lip or groove 32, at which to cut and sever the top portion of such barrel as will be further explained, each opening 34 and 36 corresponding to and establishing the severance location for a barrel 10 of a predetermined size. For example, when properly positioned on the barrel 10, the opening 34 may establish the severance line location for one embodiment of a particular barrel 10 presently used in the industry whereas the opening 36 may establish the severance line location for another barrel embodiment of a different diameter. In this regard, it is recognized that the tool or template 24 may be constructed to include any plurality of openings depending upon the various different barrel embodiments utilized in the soft drink beverage industry.

Once the tapered end portion 30 of the tool 24 is positioned within the groove or lip area 32, and with the tool end portion 30 engaged with such groove or lip 32, the tool 24 can be moved and guided around the periphery of the barrel 10. Movement of the tool 24 around the barrel periphery, as indicated, with a pencil engaged with the appropriate opening, will circumscribe the appropriate severance line on the exterior portion of the barrel side wall 12 such as the severance line 22 (FIG. 2). Use of the tool 24 will produce a severance line which is both straight and horizontally level relative to the lip or groove 32 thereby providing an accurate guide from which to sever the top portion of the barrel 10.

Figure 4:
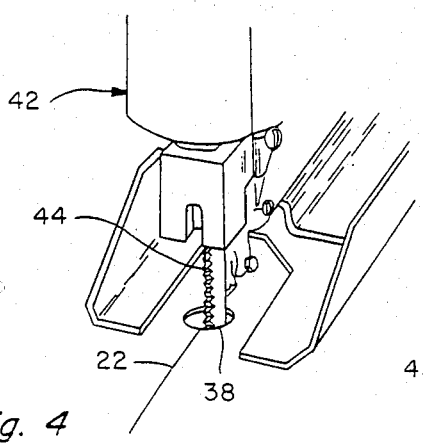
FIG. 4 is a perspective view showing one method for uniformly severing the top portion of the subject barrel so as to obtain a substantially smooth, level and even cut around the top peripheral edge of the severed barrel.

Actual cutting of the molded plastic barrel along the severance line 22 can be accomplished by any suitable means. One method for accomplishing this task is to use a saber saw such as the saber saw 42 illustrated in FIG. 4. In order to facilitate insertion of the saw blade 44 into the barrel side wall 12 at a location along the severance line 22, it is recommended that a suitable size opening 38 be drilled through the side wall 12 at any location along the severance line 22. The opening 38 should be sufficiently large so as to not only allow insertion of the saw blade 44 therethrough, but it should also allow an operator to easily align the blade 44 with the severance line 22 so that a straight and accurate cut along such line can be accomplished. The opening 38 may be formed by any suitable drill means such as by the drill 40 illustrated in FIG. 2. Although other suitable cutting means are available, use of the saber saw 42 produces a smooth, straight and accurate cut and substantially prevents splintering of the barrel side wall 12 along the entire cutting surface.

Figure 5:
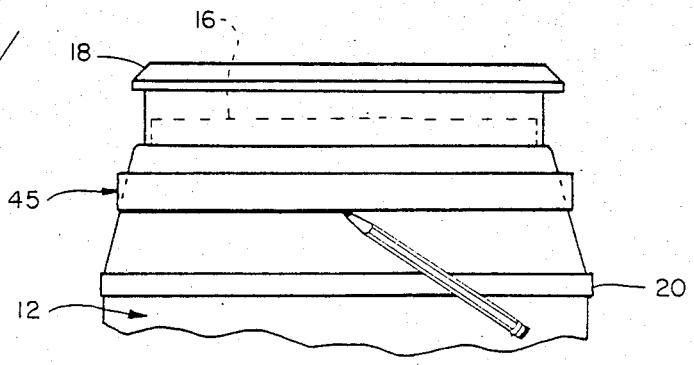
FIG. 5 is a partial side elevational view showing another method for predetermining the location adjacent the top portion of the barrel at which to sever the same.

FIG. 5 illustrates another method for predetermining the location adjacent the top portion of the barrel 10 at which to sever the same. In this instance, an annular sizing ring 45 is used to accomplish this task. The sizing ring 45 is dimensioned so as to correspond to the diameter and circumference of the engaging rim portion 58 associated with the chilling tub 50 (FIG. 6) and is merely inserted over the top portion of the barrel 10 as indicated in FIG. 5. The lower portion of the sizing ring 45 will engage the barrel 10 at a location where the diameter and circumference of the barrel correspond to the dimensions associated with the annular tub rim portion 58. A pencil or other marker may then be utilized to circumscribe the appropriate severance line around the barrel side wall 12 as indicated. In using the sizing ring 45, it is important that such ring be horizontally level prior to circumscribing the severance line. This can be accomplished by measuring the distance between the top edge of the sizing ring 45 and the top of the barrel 10 at various locations around the periphery thereof in order to ensure that the severance line produced from its use will be both straight and level and will provide an accurate guide from which to sever the top portion of the barrel 10. Once the severance line has been circumscribed on the barrel side wall 12, the previous method for cutting the barrel along the appropriate severance line as described above remains the same.

Figure 6:
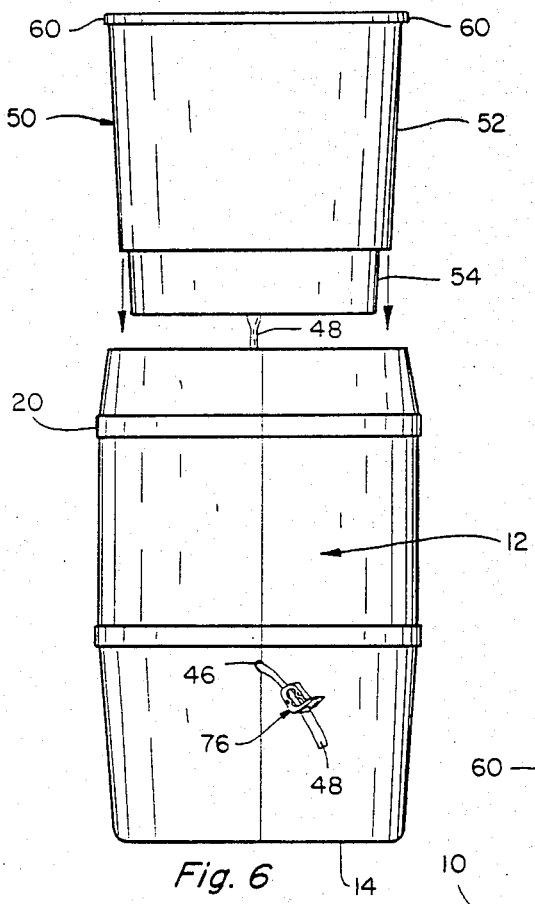
FIG. 6 is an exploded side elevational view showing insertion of the present chilling tub into the partially modified severed barrel.
Figure 7:
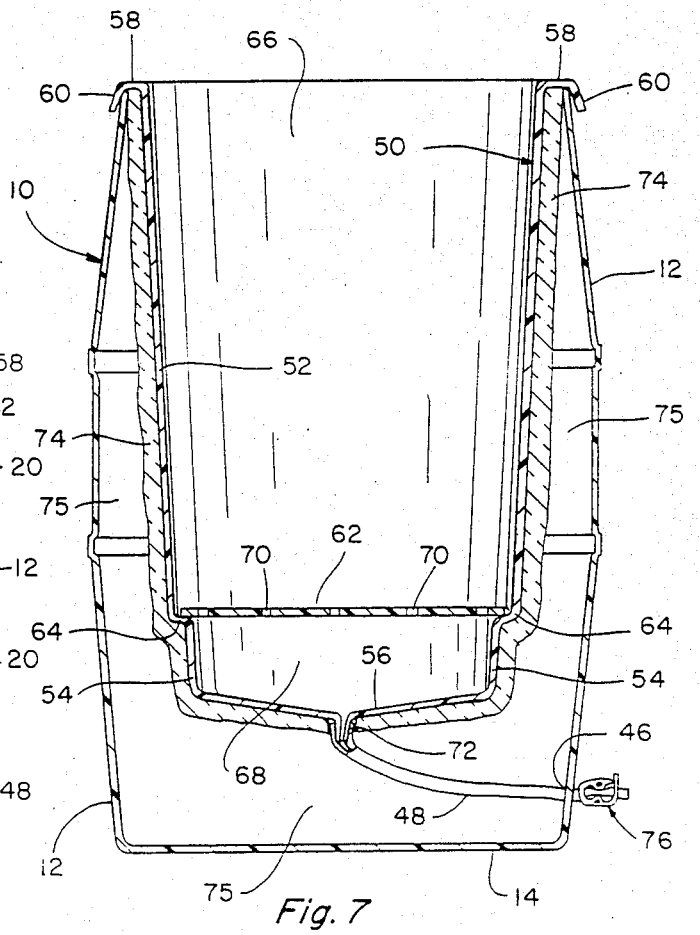
FIG. 7 is a side cross-sectional view of one embodiment of the present chilling tub positioned within the severed barrel.

Once the top portion of the barrel 10 is severed as aforementioned, and prior to insertion of the chilling tub 50 therewithin, a drain hole 46 should be drilled or otherwise formed in the lower portion of the barrel side wall 12 as illustrated in FIGS. 6 and 7. The drain hole 46 should be sufficiently sized so as to allow the drain tube 48 to pass therethrough to the outside of the unit. In this regard, the drain hole 46 should be located high enough above the bottom barrel wall 14 or other support surface such that a bucket or other receiving means may be easily positioned underneath the drain tube 48 extending therethrough to receive the liquid from the melted ice. The drain tube 48 is preferably a flexible plastic (polyethylene) tubing, although rubber or any other flexible tubing may likewise be used, if desired. For reasons of appearance and avoiding interference with customers, the opening 46 for draining the drain tube 48 to the outside of the barrel 10 should be conveniently located at the rear of the assembly, although such opening 46 can be positioned at any desired location along the barrel side wall 12. Positioning the drain hole 46 at the rear of the finished assembly enhances the overall attractiveness of the unit and avoids interference with customers and accidental drainage of the drain tube 48.

Referring to FIGS. 6 and 7, the chilling tub 50 is preferably a one-piece vacuum formed or molded plastic construction having an upper annular side wall 52, a lower annular side wall 54, a bottom wall 56, a top rim portion 58, and an annular downturned edge 60. A substantially flat platform or floor member 62 is sized and dimensioned to rest upon and be supported by the intermediate annular lip or shoulder surface 64 formed between the annular side walls 52 and 54, the floor member 62 dividing the chilling tub 50 into an upper product holding portion 66 and a lower reservoir portion 68. The member 62 is substantially circular in shape to conform to the substantially cylindrical shape of the tub 50 and can be conveniently made and sized from any suitable materials. The purpose of the floor member 62 is to hold and support the various types of product and ice positioned within the product holding area 66. In this regard, the floor 62 also includes a plurality of openings 70 extending therethrough so as to allow the chilled waste water from the melting ice to seep and otherwise drain therethrough into the reservoir portion 68 located therebelow. It is also recognized that the floor 62 may likewise be integrally formed with the side walls 52 and/or 54 of the tub 50.

The reservoir portion 68 of the tub 50 is formed integral therewith and is defined by the annular side wall 54, the bottom wall 56, and the floor member 62. As formed, the reservoir portion 68 is provided with a drain hole and nipple 72 located in the bottom wall 56, which nipple 72 is adapted to accept the drain tube 48 for conducting the liquid from the melting ice which accumulates in the reservoir area 68 to suitable receiving means such as a bucket located exterior to the unit. In this regard, it should be noted that the fluid outlet 72 is centrally located in the middle of the bottom wall 56 at the lowermost portion thereof, the bottom wall 56 being tapered or funneled inwardly and downwardly towards the center thereof as shown in FIG. 7. This enables any waste water accumulated within the reservoir 68 to flow unrestrictedly to the fluid outlet 72 thereby preventing unwanted trapping of such liquid within the reservoir. The overall size of the reservoir area 68 should be of sufficient capacity to accommodate the waste water resulting from the melting of the ice positioned thereabove. This will depend upon the overall size of the product holding area 66 and the anticipated amount of ice necessary to occupy such space.

As shown in FIG. 7, the chilling tub 50 is shaped and dimensioned so as to fit within the severed barrel 10 and is suspended therein from the top severed edge thereof by the rim portion 58. The chilling tub 50 is secured in such position by the annular downturned edge 60. In this regard, it is important that the top peripheral edge of the severed barrel 10 engage the projecting downturned rim portions 58 and 60 as shown in FIG. 7 so that the tub 50 will be adequately supported when filled with both product and ice. The chilling tub 50 also includes insulation means such as the insulation 74 (FIG. 7) which is positioned to surround and insulate the annular side walls 52 and 54 as well as the bottom wall 56 of the tub 50. Any suitable insulation means such as a foam type insulation which may be sprayed onto the exterior portion of the chilling tub 50 or insulation in the form of styrofoam may be used to insulate the chilling tub so as to keep the products placed therein cold for as long as possible. It is also important to note that when the tub 50 is properly engaged and suspended within the barrel 10, a closed uninterrupted air space 75 (FIG. 7) is formed between and around the tub 50 and the inside portion of the barrel 10 thereby further insulating the member 50 and the products positioned therein. The closed insulating air space 75 further improves the operating efficiency and the ability of the converted display unit to keep items cold.

Figure 8:
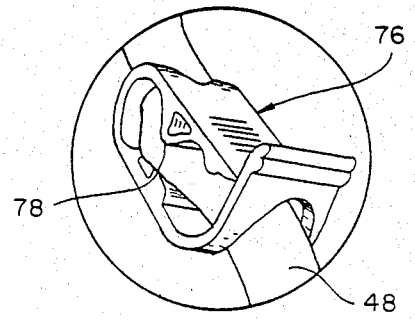
FIG. 8 is a partial perspective view showing the clamp means associated with the drainage tube for controlling removal of the melted ice water from within the reservoir means.

During the conversion and assembly process, it should be remembered that prior to inserting the chilling tub 50 within the severed barrel 10, one end portion of the drain tube 48 must be securely attached to the fluid outlet 72 and the opposite end portion thereof must be fed through the drain hole 46 as best illustrated in FIG. 6. Once this is accomplished, the tub 50 may be properly seated on and within the barrel 10 and any excess amount of tubing 48 extending through the opening 46 may be either fed back through such opening for storage within the barrel 10, or such excess tubing may be severed accordingly. Suitable clamping means such as the drain clamp 76 as best shown in FIG. 8 may be positioned on the terminal end portion of the tube 48 to control removal of the melted ice liquid from the reservoir means 68. As shown in FIG. 8, when the clamp 76 is moved to its closed position, clamp portion 78 pinches the tubing 48 at such location and restricts the flow of fluid therethrough. When moved to its open position, the clamp 76 allows a free flow of fluid through the tube 48. This provides a simple and easy means for emptying the reservoir 68 without having to unload or move the chilling tub 50 from the overall assembly. Also, as previously explained, prior to insertion of the chilling tub 50 into the severed barrel 10 (FIG. 6), the modified barrel should be thoroughly cleaned both inside and out as aforementioned.

Figure 9:
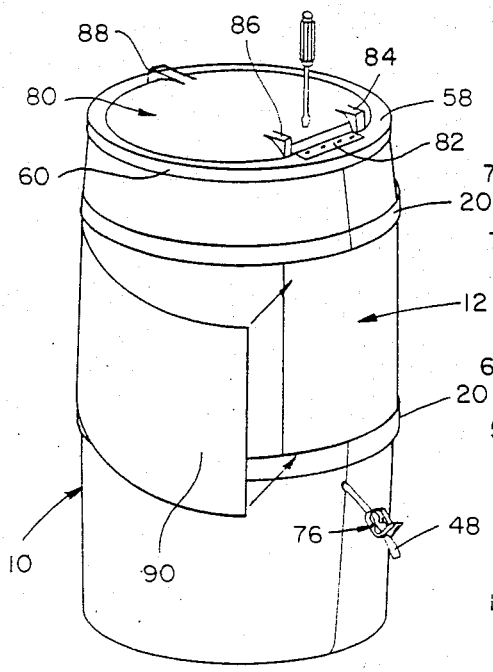
FIG. 9 is a perspective view of the fully converted barrel assembly constructed according to the teachings of the present invention, such view illustrating the lid member, the hinge means, and the positioning of the graphic wrap member around the exterior portion thereof.
Figure 10:
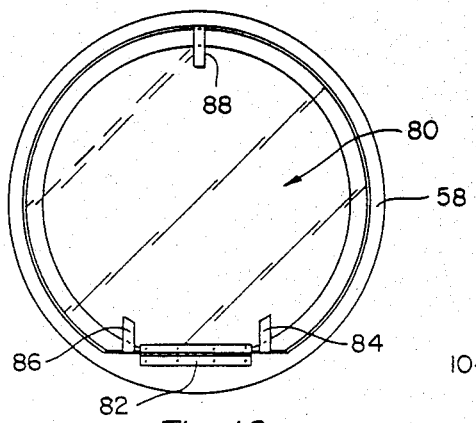
FIG. 10 is a top plan view of the converted barrel assembly of FIG. 9 further illustrating the lid member, the hinge means, and the top rim member associated with the chilling tub.

Once the chilling tub 50 is inserted and seated within the severed barrel 10, a pivotal lid member 80 may be hingedly attached to the top rim portion 58 of the tub 50 by suitable fastening means. The lid member 80 is preferably made of a clear plastic material to enhance the visibility of the products displayed within the tub 50 and includes a straight flat segment along a portion of the periphery thereof which facilitates attachment of the hinge member 82 to the rim portion 58 by suitable means as shown in FIGS. 9 and 10. The lid 80 is formed with a domed center and likewise includes three projecting bosses 84, 86 and 88. Bosses 84 and 86 serve as stop means to maintain the lid 80 in an erect position when moved to its open position, while boss 88 serves as a handle for grasping and lifting the lid member 80 to its open position. The lid 80 made of clear plastic offers an attractive appearance and renders the products in the chilling tub 50 readily visible and accessible to customers. Although a particular dome shaped lid member is illustrated in FIGS. 9 and 10, it is anticipated and recognized that the lid member 80 may be fashioned in a variety of different shapes including a substantially flat lid member, a lid member having handle means of various sizes and shapes as well as having such handle means positioned at various locations on said lid member, and such lid member may be made of an opaque material as compared to a clear plastic material. Also, it is likewise anticipated and recognized that the lid member 80 may be non-pivotable and simply rest upon or otherwise engage positioning and locating means on the top rim portion 58 of the chilling tub 50.

Completing the finished converted barrel display for holding chilled products and the like is the optional use of signage or other indicia which may be affixed to the exterior portion of the barrel side wall 12 to further enhance the beauty and appearance of the overall assembly and/or to promote and advertise the sale of the particular chilled products stored and displayed therein. This signage can take the form of a graphic wrap 90 which may be easily and conveniently adhesively attached to the exterior portion of the barrel side wall 12 as illustrated in FIG. 9. In the particular embodiment illustrated in FIG. 9, the graphic member 90 is wrapped and overlaid around the periphery of the barrel side wall 12 between the annular reinforcing members 20. It is anticipated and recognized that other graphic arrangements and artistic designs may likewise be utilized and incorporated onto the exterior portion of the modified barrel 10 such as through the use of decals and the like.

Figure 11:
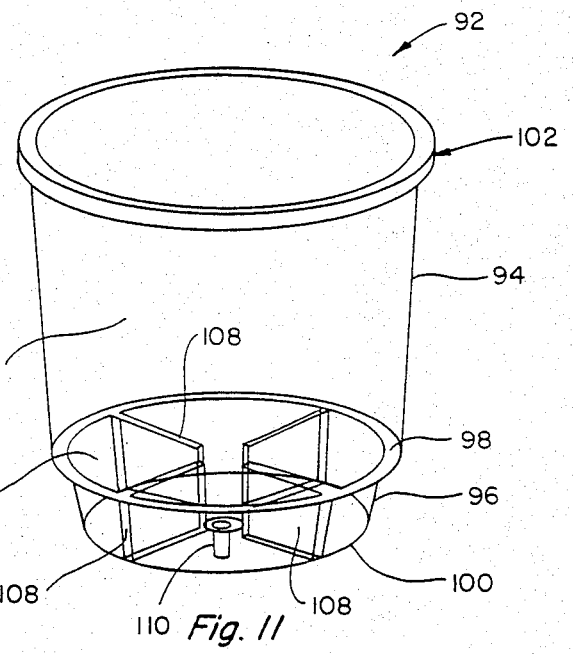
FIGS. 11–13 are perspective views illustrating still further embodiments of the present chilling tub, such embodiments being shown without insulation means surrounding the same and the inner support structure associated respectively therewith being shown in solid outline form for clarification purposes only.
Figure 12:
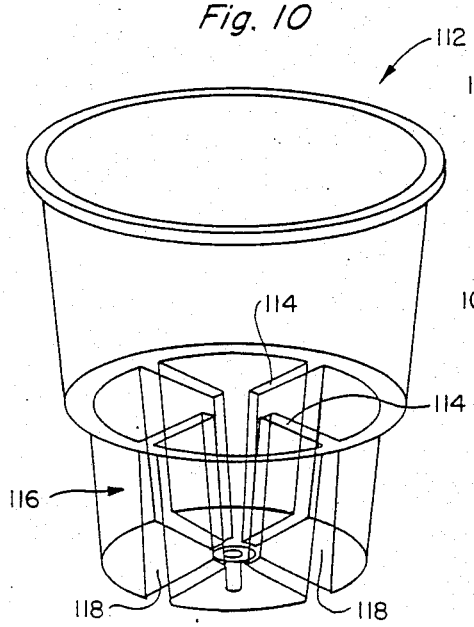
Figure 13:
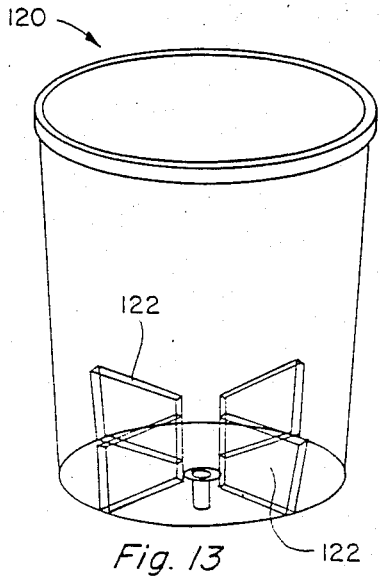

FIGS. 11–13 illustrate several different embodiments of the present chilling tub 50, these various constructions differing from the construction of the tub 50 primarily with respect to the additional support structure positioned within the reservoir means. More specifically, the chilling tub 92 illustrated in FIG. 11 is similar in construction and operation to the chilling tub 50 disclosed in FIGS. 6 and 7 and includes an upper annular side wall 94, a lower annular side wall 96, an intermediate annular lip or shoulder surface 98 formed between the side walls 94 and 96, a substantially flat bottom wall 100, and a projecting, downturned top rim portion 102 which is substantially similar to the top rim portions 58 and 60 associated with the tub 50. Like the chilling tub 50, a floor member (not shown) similar to the floor 62 (FIG. 7) is likewise designed to rest upon and be supported by the annular shoulder surface 98, such floor similarly dividing the tub 92 into an upper product holding area 104 and a lower reservoir area 106.

The tub arrangement 92 differs from the tub 50 in that the reservoir portion 106 includes a plurality of upright support members 108. The support members 108 extend upwardly from the bottom wall 100 to the annular shoulder surface 98 as shown in FIG. 11 such that when the floor member is positioned to rest upon the shoulder surface 98, such floor will also rest upon and be supported by each of the support members 108. Also, as shown in FIG. 11, each support member 108 extends inwardly from the annular side wall 96 towards the center of the reservoir 106. Importantly, however, the support members 108 do not extend all the way to the center of the bottom wall 100, but instead, stop short of the fluid outlet 110 located in the center thereof thereby forming an open space therearound. This arrangement allows the liquid from the melting ice which accumulates in the reservoir 106 within the somewhat segregated spaces between adjacent support members 108 to flow to the fluid outlet 110 without hinderance or obstruction. It is preferred, although not necessary, that the support members 108 be integrally formed with the annular side wall 96 as well as with the bottom wall 100 and that such members be made or formed of a solid material so as to add strength and rigidity thereto. As indicated, the support members 108 give added support to the floor member positioned thereabove particularly under the weight of the various products and ice positioned thereabove. In all other respects, the chilling tub 92 functions and operates substantially similar to the chilling tub 50.

FIG. 12 illustrates still another modified embodiment 112 of the present chilling tub, the tub construction 112 being substantially similar to the tub construction 92 in that it likewise includes a plurality of support members 114 positioned within the reservoir portion 116. However, the support members 114 differ in construction from the support members 108 in that the members 114 are substantially hollow and each includes a space 118 formed by and between the respective top, bottom, side, and one end portion thereof as illustrated in FIG. 12. This construction usually results when the members 114 are made from a vacuum forming process. Although this particular construction of the support members 114 is not as strong as the construction of the members 108, it likewise provides additional support to the floor member (not shown) positioned thereupon. As shown in FIGS. 11 and 12, it is recognized that the overall size of the reservoir means may vary depending upon the particular application and the total amount of product and ice to be positioned within the product holding area of the chilling tub. It is also recognized that additional reinforcing members could likewise be incorporated into the reservoir area associated with each of the tub members 92 and 112. In all other respects, the tub 112 functions and operates substantially similar to the tub 92.

FIG. 13 discloses still another modified chilling tub 120. The embodiment 120 likewise includes a plurality of support members 122 and is substantially similar to the embodiment 92 (FIG. 11) but differs therefrom in that the annular lip or shoulder surface 98 has been eliminated. Since the floor member such as the member 62 (FIG. 7) rests upon and is adequately supported by the support members 122, use of the shoulder surface 98 is no longer necessary. This simplifies the construction of the chilling tub and reduces the overall manufacturing cost in making the same. This same modification is true with respect to the embodiment 112 illustrated in FIG. 12.

It is also recognized that support means such as the support members 108 or 114 can likewise be integrally formed or otherwise attached to the underside portion of the floor member such as the floor 62 (FIG. 7) thereby eliminating the need for forming such support means as part of the reservoir cavity. In this particular case, the support means would extend downwardly from the underside portion of the floor member so as to rest upon and be supported by the bottom wall of the reservoir cavity. Here again, the annular shoulder surface such as the surfaces 64 (FIG. 7) and 98 (FIG. 11) could be eliminated, the floor member in such arrangement being fully supported by the support means extending downwardly therefrom as previously explained. It is likewise anticipated and recognized that the floor member 62 may be totally eliminated from the chilling tub 50 illustrated in FIG. 7 and the ice and product may be fully supported by the bottom wall 56. Still further, a plurality of casters (not shown) may also be mounted on the lower surface of the barrel bottom wall 14 by any suitable means so as to confer easy mobility to the finished assembly without the need of unloading or draining the chilling tub before moving the entire assembly from one location to another.

Although the method and apparatus disclosed herein for converting the barrel 10 into a display assembly for holding chilled products has been directed to severing the top portion of the barrel 10 as illustrated in FIGS. 1–7, namely, removing the top wall 16 and the nesting ring 18 therefrom, it is also recognized that the entire conversion method described herein will work equally well regardless of which end of the barrel 10 is initially severed. In fact, when so inverted, the annular nesting ring 18 provides a stable base for supporting the barrel 10 in its inverted position when placed on a floor or other suitable support surface. In this particular case, it may be necessary to recalibrate the sizing tool 24 (FIG. 3) so that the openings 34 and 36 are positioned to establish and locate the appropriate severance location on the barrel 10 for severing, in this case, the bottom portion of such barrel. In all other respects, the present method and apparatus for accomplishing the subject conversion would remain the same.

Figure 14:
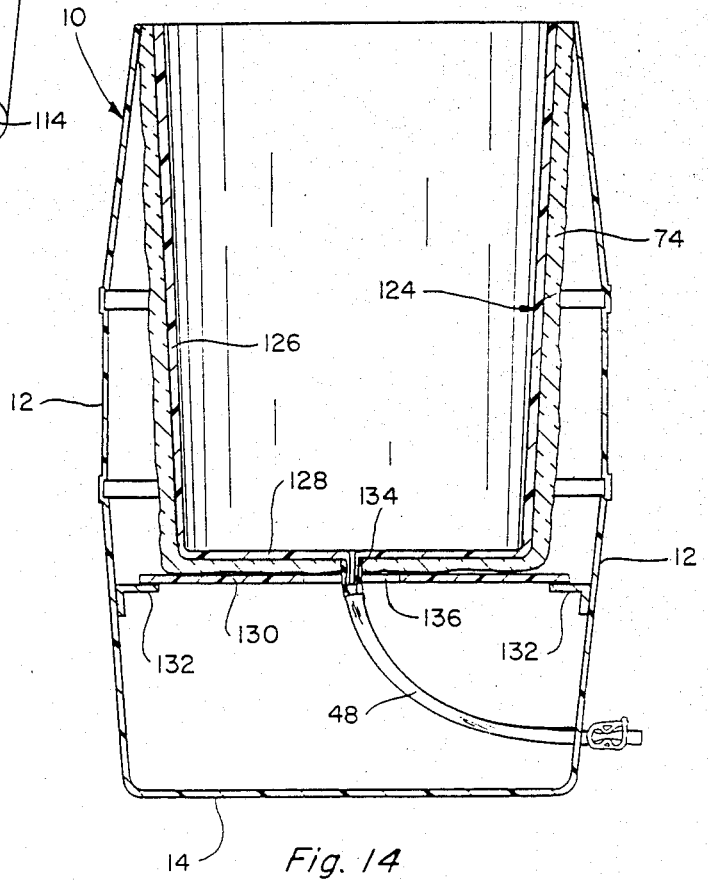
FIG. 14 is a side cross-sectional view of still another embodiment of the present chilling tub showing other support means for supporting the chilling tub within the converted barrel.

Although use of the downturned annular rim support means 58 and 60 (FIG. 7) is preferred, it is also recognized that the present tub member such as the members 50, 92, 112 and 120 may likewise be adequately supported within the barrel 10 by a wide variety of other support arrangements. For example, FIG. 14 illustrates still another embodiment 124 of a chilling tub for use in conjunction with the present barrel conversion method, the tub member 124 including an annular side wall 126 and a bottom closure wall 128. The tub 124 is substantially cylindrical in shape and, like the members 50, 92, 112 and 120, is preferably of a one-piece vacuum formed or molded plastic construction. However, unlike the tub members 50, 92, 112 and 120, the tub 124 does not include annular rim support means adjacent the top end portion thereof. Instead, the tub 124 is fully supported within the barrel 10 by the floor member 130 shown in FIG. 14. The floor 130 is substantially circular in shape to conform to the substantially cylindrical shape of the barrel 10 and can also be conveniently made and sized from any suitable materials. The floor 130 is positionable within the severed barrel 10 and can be easily attached to the side wall of the barrel 10 through conventional bracket means. For example, the floor 130 can rest upon and be supported by a plurality of L-shaped brackets 132 positioned in spaced apart relationship around the interior portion of the barrel side wall 12 as shown in FIG. 14. Other bracket arrangements will likewise work equally as well including supporting the tub 124 by a pedestal type member or other support arrangement (not shown) which may be anchored or otherwise fastened or secured to the bottom wall 14 of the barrel 10. Also, the floor 130 may be fabricated with an upstanding annular edge flange (not shown), the upstanding annular flange being adapted for engagement with and attachment to the barrel side wall through conventional fastening means. It is anticipated that still other support means may likewise be utilized for supporting the tub 124 within the barrel 10 without departing from the spirit and scope of the present invention.

The bottom wall 128 of the tub 124 may likewise include fluid outlet means in the form of a drain hole and nipple arrangement 134 located in the central portion thereof, the nipple arrangement 134 being adapted to accept the drain tube 48 for conducting the liquid from the melting ice which accumulates in the tub 124 to suitable receiving means located exterior to the converted unit as previously explained. In this regard, the floor member 130 should include an opening 136 for allowing the nipple 134 to extend therethrough as shown in FIG. 14. The tub 124 may also include insulation means such as the insulation 74 which is positioned to surround the member 124 as shown in FIG. 14. Although not shown, it is further recognized that the tub member 124 may likewise include a segregated reservoir portion similar to the various reservoir constructions shown and illustrated in FIGS. 7 and 11–13 such as the reservoirs 68, 106 and 116. Also, although the present method and apparatus for converting a barrel type unit into a display assembly for holding products is primarily directed to converting barrel units having an upper annular portion of a somewhat smaller circumference or girth as compared to other annular portions thereof, it is importantly recognized that the present method and apparatus including the present tub members 50, 92, 112, 120 and 124 will work equally as well with any of the different types of concentrate barrels presently being used throughout the soft drink industry as well as with a wide variety of other barrel type units or enclosures including traditionally shaped barrels having a uniform diameter or girth throughout their entire height.

The various components which have now been described can be provided in a conversion kit along with suitable instructions as set forth above so that any non-skilled personnel, with minimum tool requirements, could easily convert an empty syrup and/or concentrate barrel 10 into a free-standing merchandising display unit for holding chilled products as illustrated in FIG. 9. In use, such a converted assembly, which can accommodate a large number of beverage cans along with cracked or cubed ice for chilling the same, can be filled with the various products for sale and ice for chilling the same and then the entire assembly can be rolled by means of the optional casters to the desired store location. Alternatively, the finished converted assembly could be pre-positioned at the desired location prior to filling the same. As the original ice charged to the chilling tub melts, the water is drained to the reservoir area associated therewith and more ice can be added. At selected relatively long-time intervals, the reservoir means can be emptied by opening the clamping means 76 and draining the contents of the reservoir into any convenient container. Thus, the finished converted assembly can be refilled repeatedly when its contents are depleted and its location changed as desired without the need of emptying the chilling tub or disassembling any of the unit's components.

Although the finished converted assembly for holding chilled products has been described in connection with the chilling, storage and display of soft drink type beverages, it can likewise be used for chilling, storing and displaying other articles of merchandise such as fruit juices, milk, beer and the like including storing and displaying non-chilled products as well. Also, it is anticipated and recognized that the present method and apparatus described herein can be utilized to convert any barrel type unit on location, or at the manufacturing plant, factory or warehouse, regardless of its size, shape, materials of construction, and originally designed use into a free standing display for holding both chilled and non-chilled products and the like. In this situation, the various components of the present system and, in particular, the various chilling tub embodiments disclosed herein, may be correspondingly shaped to conform to the particular shape of the barrel unit to be converted without departing from the teachings and practice of the present invention. Also, when used to hold non-chilled products, the reservoir portions illustrated herein may be deleted and a tub structure similar to the tub member 124 may be utilized to obtain greater pack out capacity. The simplicity, durability, flexibility and versatility of the present method and apparatus not only eliminates the disposal and environmental problems associated with such barrels, but it likewise greatly increases its usefulness and effectiveness in encouraging and promoting point-of-purchase sales particularly with respect to storing and displaying chilled products to consumers.

Thus, there has been shown and described a novel method and apparatus for converting barrel type units into free standing displays for holding chilled or non-chilled products, which method and apparatus fulfills all of the objects and advantages sought therefor. Many changes, modifications, variations and other uses and applications of the present method and apparatus will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A kit for converting a storage barrel into a container for holding chilled products, said storage barrel including closed top and bottom end portions and a continuous side wall extending therebetween, said conversion kit comprising the components of (a) a tub member adapted to hold ice and product positioned therein, said tube member having an upper end portion of a predetermined size and shape and including means for draining the same, (c) means for supporting said tub member within said storage barrel after said barrel is severed at said predetermined severance location, said support means enabling the upper end portion of said tub member to lie substantially adjacent to the severed end portion of said storage barrel when positioned therewithin, and (b) sizing means including means for determining the particular location on said barrel side wall at which to sever said barrel such that the upper end portion of said tub member will lie substantially adjacent to the severed end portion of said storage barrel when said tub member is positioned and supported therewithin, (d) drain tubing cooperatively engageable with the drain means associated with said tub member for emptying the accumulated waste water formed therein, said drain tubing providing means for conducting the accumulated waste water from said tub member to the exterior thereof, said kit components being grouped together and provided to a user for accomplishing said barrel conversion.

2. The conversion kit of claim 1 including a lid member and means for attaching the same to the upper end portion of said tub member.

3. The conversion kit of claim 1 including advertising indicia attachable to the exterior portion of said storage barrel.

4. The conversion kit of claim 1 including means engageable with said drain tubing for controlling the removal of the waste water accumulated within said tub member.

5. The conversion kit of claim 1 wherein said support means includes annular rim support means on said tub member, said rim support means being engageable with the severed edge portion of said storage barrel when said barrel is severed at said predetermined location and said tub member is positioned therewithin.

6. The conversion kit of claim 1 wherein said support means includes a floor member positionable within said storage barrel, said floor member being cooperatively engageable or attachable to the side wall of said storage barrel intermediate the top and bottom end portions thereof.

7. The conversion kit of claim 1 wherein said support means are associated with the lower end portion of said tub member, said support means engaging the bottom end portion of said storage barrel when said tub member is positioned therewithin.

8. The conversion kit of claim 1 including providing means for controlling the removal of the waste water accumulated within said tub member.

9. A kit for converting a barrel type unit into a display assembly adaptable for holding chilled products, said barrel unit including annular wall means and opposed to and bottom end portions, said conversion kit comprising the components of (a) a tub member adapted to hold cooling means and product positioned therein, said tub member having an upper end portion of a pre-selected annular dimension and including means adjacent the top end portion thereof for supporting said member within said barrel unit, said support means being cooperatively engageable with an annular edge portion of said barrel unit at a particular perpheral location intermediate the opposed end portions thereof when said barrel unit is severed at such location, said tub member further including means for draining the accumulated waste water formed therein, (b) sizing mean for determining the particular location on said barrel wall means at which to sever said barrel unit such that the support means of said tub member will cooperatively engage the severed annular edge portion of said barrel unit when said tub member is positioned therewithin, (c) a lid member including means for attaching the same to the upper end portion of said tub member, and (d) means engageable with the drain means associated with said tub member for conducting the waste water accumulated therein from said tub member to the exterior thereof, said kit components being packaged and provided to a user for accomplishing said barrel conversion.

10. A kit for converting a barrel type unit into a display assembly for holding chilled products, said barrel unit including opposed top and bottom end portions and a continuous side wall extending therebetween, said continuous side wall having an upper annular portion of a smaller circumference as compared to other annular portions associated therewith, said kit comprising the components of (a) a tub member adapted to hold ice and product positioned therein, said tub member including annular rim support means of pre-selected size and shape adapted to be cooperatively engageable with a peripheral edge portion of said barrel unit when the upper annular side wall portion thereof is severed at a particular location therearound, said tub member further including fluid outlet means for draining the same, (b) sizing means to determine the particular location on the upper annular barrel side wall at which to sever the same, said sizing means enabling a user to locate the particular severance location at which the diameter of the upper annular barrel side wall is approximately the same as the diameter of the annular support means of said tub member, and (c) drain tube means cooperatively engageable with the fluid outlet means of said tub member for removing the waste water accumulated therein, said kit components being provided to a user for accomplishing said barrel conversion.

11. The conversion kit of claim 10 wherein said sizing means includes a tool, said tool being engageable with the exterior portion of said upper annular barrel side wall at a predetermined location therearound and including means for locating the particular severance location at which to sever the same such that the annular barrel edge portion resulting therefrom will be compatible for engagement with the support means associated with said tub member.

12. The conversion kit of claim 11 wherein said tool means includes at least one opening extending therethrough, said opening being positioned and located on said tool so as to locate said severance location when engaged with said upper barrel side wall at said predetermined location.

13. The conversion kit of claim 10 wherein said sizing means includes an annular ring member, said ring member being positioned around the upper annular portion of said barrel side wall and being dimensioned so as to engage the barrel side wall at a location which, when severed at such location, will produce an annular edge portion compatible for engagement with the support means associated with said tub member.

14. The conversion kit of claim 10 wherein said sizing means includes means for guiding said tool around the periphery of said upper annular side wall and means for circumscribing a line with a marking device around said barrel, said line providing guidance for guiding a cutting member around said barrel while cutting the same.

* * * * *

UNITED STATES PATENT AND TRADEMARK OFFICE

CERTIFICATE OF CORRECTION

PATENT NO. : 4,982,840

DATED : January 8, 1991

INVENTOR(S) : Christopher C. Bidwell & Dewalt W. Fowler

It is certified that error appears in the above-identified patent and that said Letters Patent is hereby corrected as shown below:

Column 1, line 43, "easY" should be --easy--.

Column 14, line 24, "tube" should be --tub--.

Signed and Sealed this

Fifth Day of May, 1992

*Attest:*

DOUGLAS B. COMER

*Attesting Officer*

*Acting Commissioner of Patents and Trademarks*